United States Patent [19]

Deutsch

[11] 4,332,183

[45] Jun. 1, 1982

[54] AUTOMATIC LEGATO KEYING FOR A KEYBOARD ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 184,707

[22] Filed: Sep. 8, 1980

[51] Int. Cl.[3] ..... G10H 1/02

[52] U.S. Cl. ..... 84/1.26; 84/1.13; 84/1.24

[58] Field of Search ..... 84/1.26, 1.27, 1.24, 84/1.13

[56] References Cited

U.S. PATENT DOCUMENTS 3,809,786 5/1974 Deutsch ..... 84/1.01
3,929,053 12/1975 Deutsch ..... 84/1.24
3,951,030 4/1976 Deutsch ..... 84/1.25

*Primary Examiner*—J. V. Truhe
*Assistant Examiner*—Forester W. Isen
*Attorney, Agent, or Firm*—Ralph Deutsch

[57] ABSTRACT

In a keyboard operated electronic musical instrument a detector is provided for measuring the time interval between successively actuated keyswitches. If the time interval is less than a preselected time threshold, the notes are generated with a normal ADSR envelope and if the time interval exceeds this time threshold then the notes are generated with a legato ADSR envelope. Provision is provided to accomodate variations in time when a chord is played. The system will return to the normal ADSR for time intervals greater than that for a second preselected time threshold for notes played with large time separations. The same control signals are provided to control other musical effects such as tone selection, vibrato and portamento.

10 Claims, 8 Drawing Figures

AUTOMATIC LEGATO KEYING FOR A KEYBOARD ELECTRONIC MUSICAL INSTRUMENT

BACKGROUND OF THE INVENTION

1. Field of the Invention

This invention relates broadly in the field of electronic musical tone generators and in particular is concerned with provision for automatically varying the tone envelope modulation with changes in playing speed.

2. Description of the Prior Art

Keyboard operated electronic musical instruments tend to produce mechanical-like tonal responses which are very unlike those produced by skilled musicians playing conventional acoustic orchestral musical instruments. Various systems have been proposed and implemented whose object is to reduce the characteristic mechanical-like precision of tone generation that is produced by the basic simple form of a keyboard operated electronic musical instrument.

Touch response systems have been used to make the loudness of a tone proportional to the speed with which a keyboard switch has been actuated. A typical touch response system is described in U.S. Pat. No. 4,121,490 entitled "Touch Responsive Electronic Piano."

Keyboard switches have been constructed to provide signals for controlling electronic musical effects such as tremolo and glide. In U.S. Pat. No. 3,835,235 entitled "Keyboard Type Electronic Musical Instrument" a photo electric arrangement is described for sensing the left-right motion of the keyboard switch as distinct from the up-down motion used in the conventional fashion to control tone generators. The left-right motion sensor output is used to provide the control signal to generate a glide or a portamento effect. In this fashion the magnitude of the effect is sensitive to the musician's individual touch on a particular key.

Systems falling under the generic name of delayed vibrato attempt to automatically imitate the method in which vibrato is used on orchestral instruments such as the violin. When a key is actuated the vibrato is not applied instantaneously. Instead after a predetermined time delay the vibrato is applied to gradually increase to its full magnitude. Thus for fast passages the vibrato is not applied if each note is released before the time delay threshold has been reached. A delayed vibrato system is disclosed in U.S. Pat. No. 3,951,030 entitled "Implementation Of Delayed Vibrato In A Computor Organ."

With the notable exceptions of the conventional pipe organ and harpsichord, a skilled musician will vary the attack of a note to lend an expressive dimension to the speed of a sequence of notes as well as to some emotional quantity. The attacks are not all uniformly alike with a mechanical-like precision characteristic of pipe organs, harpsichords, and the usual keyboard electronic musical instrument.

SUMMARY OF THE INVENTION

The present invention is directed to an arrangement for varying the attack and release time of musical tones generated by keyboard operated electronic musical instrument depending upon the manner in which consecutive notes are played.

In brief, this is accomplished by providing means whereby the time interval is measured between the actuation of successive notes. If the measured time interval is less than a preselected time interval, the later notes in the sequence of successive notes are provided with attack/release tone envelope modulation functions which are slower than that provided for notes keyed with a lesser time interval spacing. Provision is incorporated to accomodate fast musical playing which require fast attack modulation function curves. In addition logic circuitry is provided to accomodate the imprecise actuation of chords which for some reason are not all actuated, or played, in the ideal simultaneous fashion.

The net musical effect is to produce a faster attack for separated notes and to slow the attack to provide legato keying for notes keyed closer together.

It is an objective of the present invention to change the ADSR (attack, decay, sustain, release) envelope function for a tone in a manner that is automatically adaptive to the manner in which keyswitches are actuated on an organ-type keyboard array of keyswitches.

It is another objective of the present invention to incorporate a means for compensating for nonsimultaneous actuation of chord note groups.

BRIEF DESCRIPTION OF THE DRAWINGS

For a better understanding of the invention reference should be made to the accompanying drawings.

DETAILED DESCRIPTION OF THE INVENTION

Figure 1:
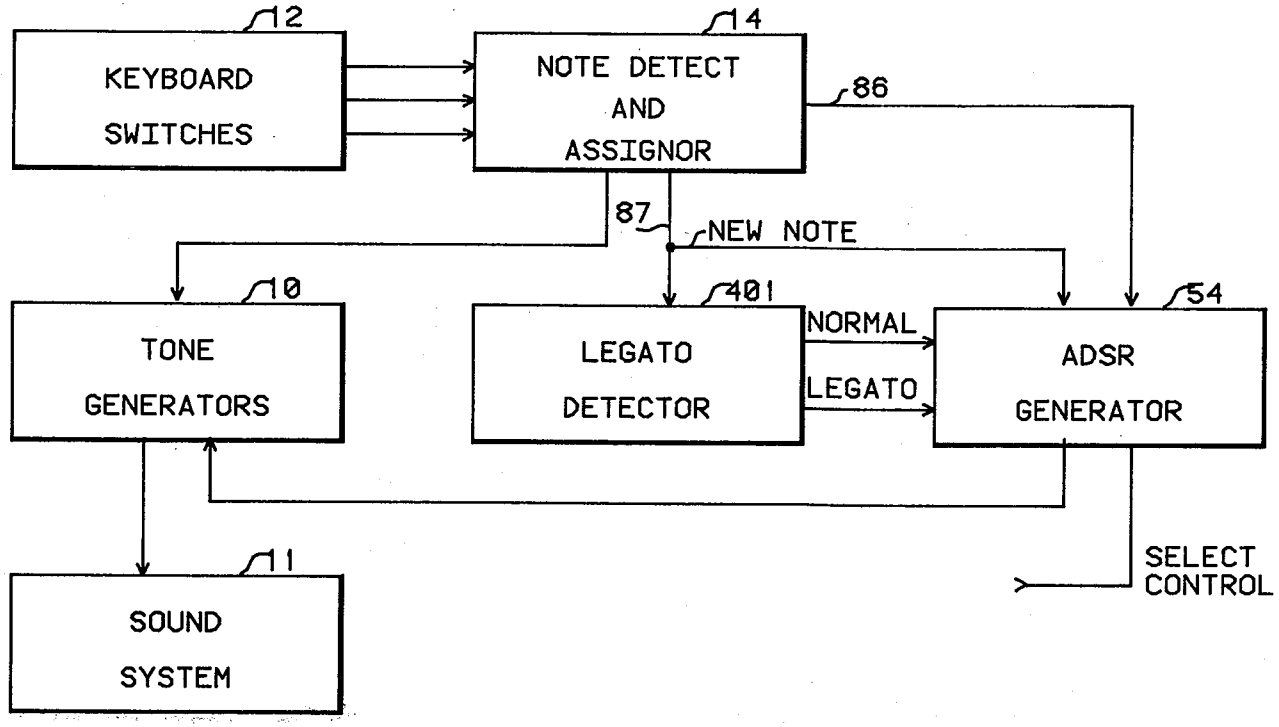
FIG. 1 is a schematic system diagram of an embodiment of the invention.

FIG. 1 shows an embodiment of the present invention which changes the ADSR envelope function for generated musical tones in a fashion which is automatically adaptive to the manner in which successive keyswitches are actuated on the array of keyboard switches 12. The keyboard switches are generally arrayed in a linear array such as that of a piano-type keyboard used with many electronic musical instruments.

The keyboard switches 12 are connected to a note detect and assign system 14. While almost any of the known types of note detect and assign systems can be used with the present invention, the invention is illustrated using a system described in U.S. Pat. No. 4,022,098 entitled "Keyboard Switch Detect And Assignor" which is hereby incorporated by reference.

Whenever a keyswitch on the keyboard switches 12 is actuated, the note detect and assignor stores information corresponding to the particular actuated note on the keyboard and assigns that key to one of a plurality of tone generators in the musical system which is not currently assigned. The plurality of tone generators are indicated symbolically by the system block labeled tone generators 10. The note information and the assignment status for each tone generator is stored in a memory (not shown) contained in the note detect and assignor 14.

When a new keyswitch is detected as being in its actuated (closed contact) state, a logic "1" state signal is generated by the note detect and assignor 14 on line 87. This NEW NOTE signal is provided to both the legato detector 401 and the ADSR generator 54. When a keyswitch which has been actuated is released (open contact), a logic "1" state signal is generated by the note detect and assignor 14 on line 86. This signal is provided to the ADSR generator 54. The legato detector 401, in a manner described below, generates either a NORMAL or a LEGATO signal which is transmitted to the ADSR generator 54.

The ADSR generator 54 can be implemented using any of the known forms of tone envelope modulation functions having the property that the speed of the attack, decay, and release phases of the modulation function can be varied in response to a control signal. A suitable ADSR generator subsystem is described in the U.S. Pat. No. 4,079,560 entitled "ADSR Envelope Generator." This patent is hereby incorporated by reference.

Figure 2:
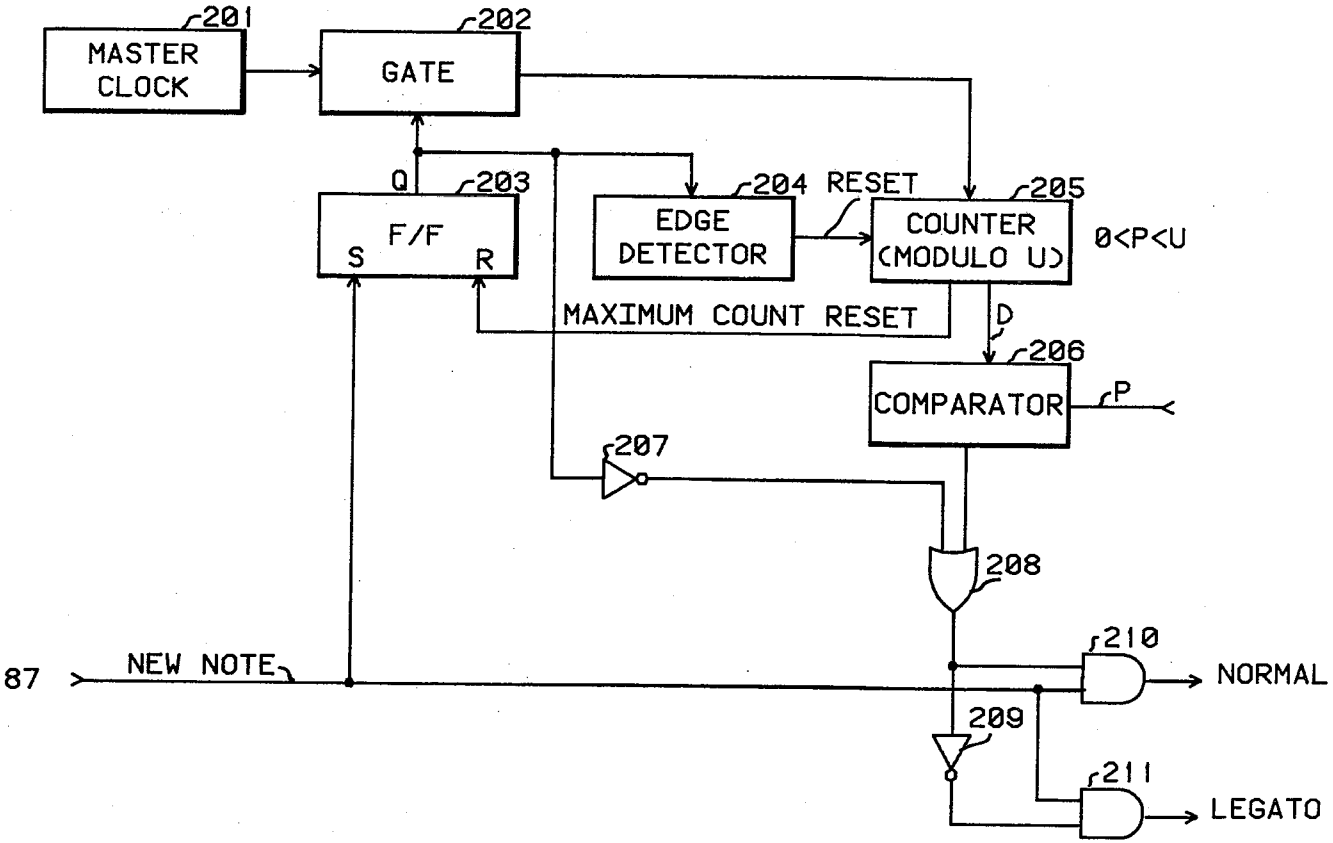
FIG. 2 is a schematic diagram of the legato detector.

The details of the legato detector are shown in FIG. 2.

Master clock 201 serves as the source of logic timing signals for the entire system.

When a new note has been detected by the actuation of a keyswitch, the NEW NOTE signal on line 87 is placed in the logic state "1" and thereby sets the flip-flop 203. When the flip-flop 203 is set, its output state changes to a Q="1". This change in state is converted to a RESET signal by means of the edge detector 204.

Counter 205 is implemented to count modulo some preselected number U. Advantageously the value of U is chosen to be a power of 2 to simplify the implementation of counter 205. When this counter resets itself (returns to its minimal count state) because of its modulo counting action, a MAXIMUM COUNT RESET signal is generated which causes the flip-flop 203 to be reset. The RESET signal created by the edge detector 204 in response to the setting of the flip-flop 203 causes the counter 205 to be reset to its minimal count state.

To illustrate the system logic, consider the situation in which the count state of counter 205 is at some number D which is less than the maximum count U. Moreover assume that D is also less than a second preselected number P. The second preselected number P is also less than the first preselected number U. D is also allowd to have a zero value corresponding to the minimal count state of the counter 205.

The count state of counter 205 is compared to the second preselected constant P in the comparator 206. The value of P can be provided in a variety of methods. P could be obtained from a keyboard input similar to a hand-held calculator, or P could be a number addressed out from an addressable memory in response to an address signal.

If the magnitude of D is less than the magnitude of P, the comparator 206 generates a "1" output logic state which is transmitted as a signal input to the OR-gate 208. Therefore if a new note has been assigned as denoted by "1" logic state on line 87, and if D is less than P, AND-gate 210 will transmit a logic "1" signal to the ADSR generator 54. This "1" signal is the NORMAL signal which will cause the ADSR generator to generate a normal attack/release for the current assigned new note. The manner in which the ADSR generator 54 responds to the NORMAL and LEGATO signal is described later.

If D is greater in magnitude than P, but still less than the maximum count U, the comparator 206 will transmit a "0" logic state via OR-gate 208 to the inverter 209. Therefore if D is greater than P, a new note signal will cause AND-gate 211 to transmit a "1" logic state to the ADSR generator 54 as the LEGATO signal. This signal indicates that the newly assigned note is to be generated with a legato attack/release.

The term attack/release is used here in a generic sense to include envelope modulation functions which only have the attack and release phases as well as more general functions which include those having attack, decay, and release phases.

When the counter 205 is allowed to reach its maximum count, which will occur in the absence of newly assigned notes, the flip-flop 203 is reset so that the next detected and assigned note will restart the previously described timing sequences.

The action of the system logic is such that notes actuated sequentially with time intervals greater than the time required to increment counter 205 to its maximum of U counts will all be furnished with a normal attack/release envelope modulation function. It should be observed that consecutive notes assigned within a time interval corresponding to P counts will all be assigned a normal attack/release envelope modulation function. This operational logic accomodates the situation in which all the notes of a chord may not be actuated in the ideal simultaneous fashion. Moreover, fast musical passages are automatically assigned the normal attack/release envelope modulation function. Notes that follow each other with a time interval greater than P and less than U will have the legato attack/release envelope modulation function with the exception of the first actuated note in such a sequence of notes. This first note will have the normal attack/release envelope modulation function. This is the type of response action that is desired in the legato style of music interpretation.

It should be noticed that the normal and legato modes for the musical instrument tone generation are entered automatically and the action is adaptive to the manner of actuating the keyboard switches as well as to the tempo at which the music is played. The threshold value of P, the second preselected constant, can be chosen to conform either to the music or to the legato style effect desired by the musician. Instead of changing the value of P to control the legato/normal action an alternative control mechanism is to vary the speed of the clock pulses furnished to the gate 202.

Figure 3:
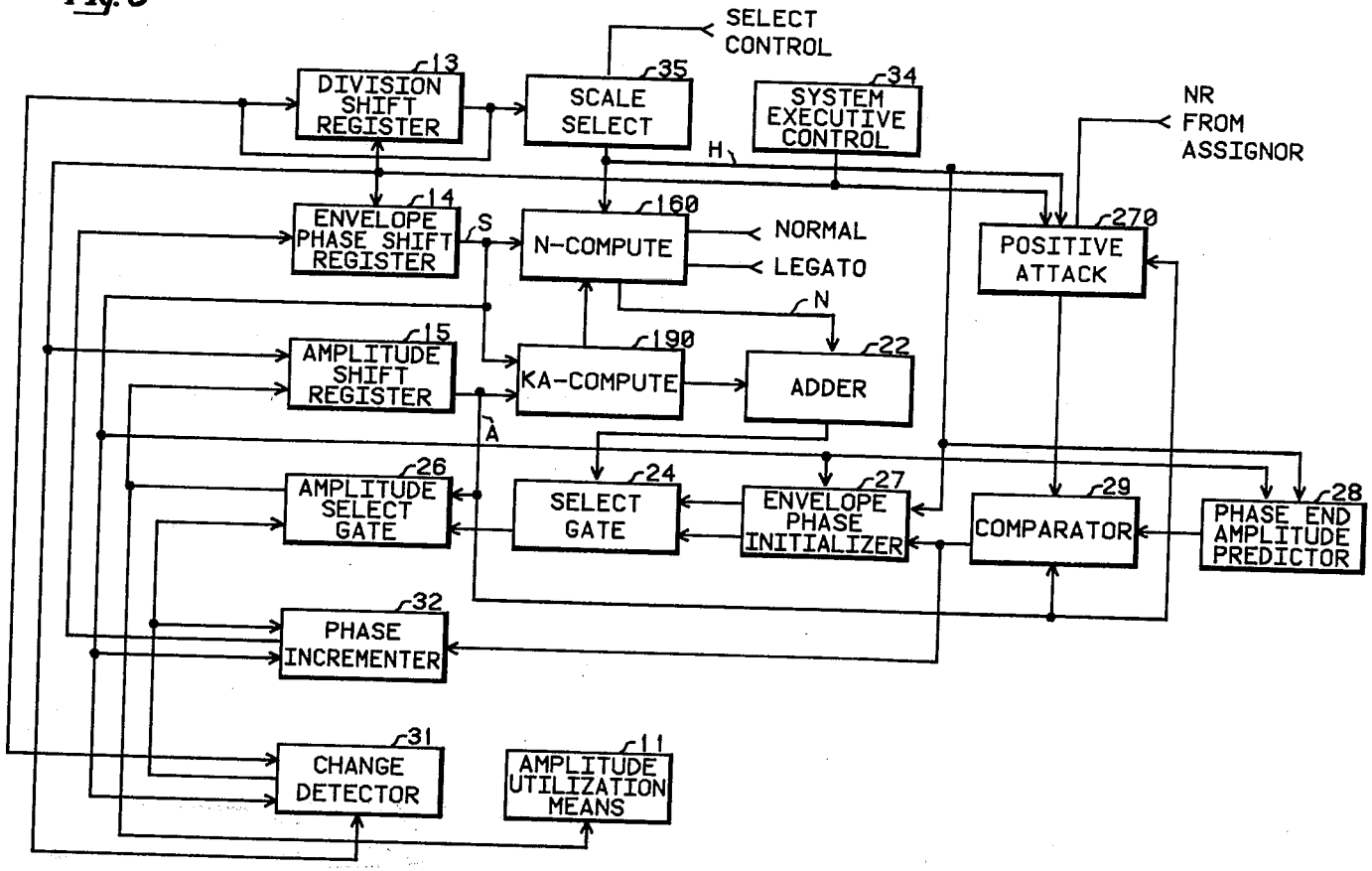
FIG. 3 is a schematic diagram of the ADSR generator.

FIG. 3 shows the details of the ADSR generator 54. This generator will provide a normal attack/release or a legato attack/release envelope modulation function in response to the output NORMAL and LEGATO control signals generated by the legato detector 401. The ADSR generator is essentially the same as that described in the previously referenced U.S. Pat. No. 4,079,650. The system logic blocks in FIG. 3 having two-digit number labels correspond to the same numbered system logic blocks shown in the figures for the referenced patent. The changes in the ADSR generator logic required for the present invention are made in the system logic blocks: N-compute 16, and the binary shift 19.

Figure 4:
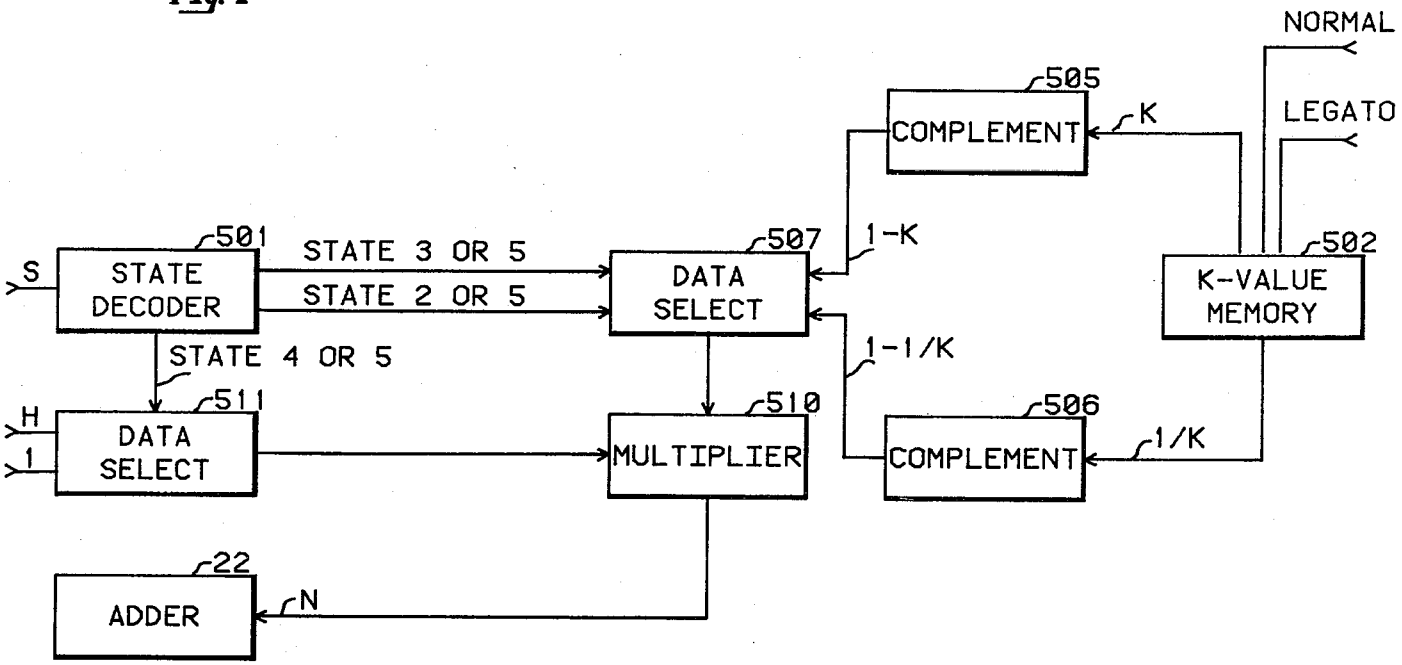
FIG. 4 is a schematic block diagram of the N-compute circuit of FIG. 3.

The N-compute 16 of the referenced patent is replaced by the N-compute 160 shown in FIG. 3. The details of the N-compute 160 are shown in FIG. 4. As described in the referenced U.S. Pat. No. 4,079,650 the envelope modulation function is divided into four regions called the attack, decay, sustain, and release. The envelope modulation function is computed for 6 amplitude phase states. States 1 and 2 comprise the attack region; states 3 and 4 comprise the decay region, and states 5 and 6 comprise the release region. The region of the envelope modulation function extending in time from the end of the amplitude phase state to the beginning of the amplitude phase state 5 comprises the sustain region of the envelope modulation function.

The ADSR envelope modulation function value A for each tone generator is computed by an iterative computation according to a relation of the form $A'=-KA+N$, where A is the preceding amplitude value, A' is the newly computed amplitude value, and K and N are prespecified constant numbers. The values of K and N will vary for each of the six phase states. The following equations show the form of the recursion relations for each phase.

Phase 1: $A'=KA+0$ Eq. 1

Phase 2: $A'=A/K-N(1-K)/K$ Eq. 2

Phase 3: $A'=KA+M(1-K)$ Eq. 3

Phase 4: $A'=A/K-MH(1-K)/K$ Eq. 4

Phase 5: $A'=KA+MH(1-K)$ Eq. 5

Phase 6: $A'=A/K+0$ Eq. 6

M is the maximum value of the ADSR envelope modulation function at the end of the phase $S=2$ and is a measure of relative loudness. H is a fractional value of M and MH is the value of the ADSR envelope modulation function during the sustain region of the tone. The value of H is selected by the SELECT CONTROL signal shown in FIG. 3. It is generally convenient to scale the modulation function by letting $M=1$. This has been done in this case.

Values of a constant K and 1/K are addressed out from the K-value memory 502, shown in FIG. 4, in response to the NORMAL and LEGATO signals generated by the legato detector 401. The numerical value of K will determine the speed of transition through the various phases of the ADSR envelope modulation function. The smaller the value of K, the slower will be the phase transition times. Two values of K, $K_1$ and $K_2$ are selected, the smaller values $K_1$ and $1/K_1$ are selected by the LEGATO signal and the larger values $K_2$ and $1/K_2$ are selected by the NORMAL signal.

The values of K and 1/K addressed out from the K-value memory 502 are in binary form and are complemented by means of the complement 505 and the complement 502. The result of the complement operation is to produce the binary values having the decimal equivalent magnitudes of $1-K$ and $1-1/K$.

State decoder 501 receives the current phase state in binary form from the envelope phase shift register 14 (FIG. 3) and decodes the binary form onto the several state signal lines shown in FIG. 4. For phase states 3 or 5, the data select 507 selects the value of $1-K$ and transfers it as one input to the multiplier 510. The data select 511 selects the value H for phase states 4 and 5 and transmits this value as the second input to the multiplier 510. For the other phase states, data select transmits the unit value of one. The output of the multiplier 510 is the value of N that is transmitted to the adder 22.

Figure 5:
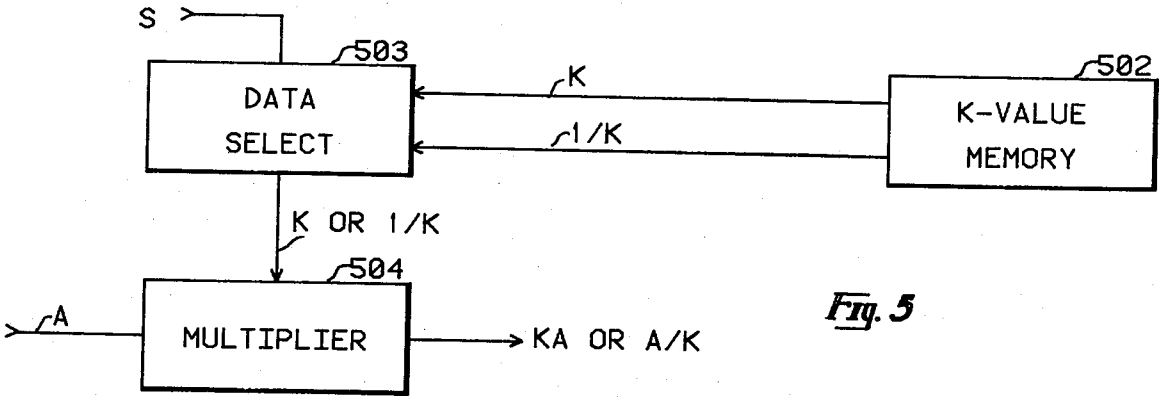
FIG. 5 is a schematic diagram of the KA compute circuite of FIG. 3.

The detailed logic for the KA-compute 190 is shown in FIG. 5. The data select 503 transmits the value of K addressed out of the K-value memory 502 to the multiplier 504 for phases 1,3 and 5 and transmits the value 1/K for phases 2 and 4. The multiplier 504 multiplies the selected constant values by the amplitude A and transfers the product value to the adder 22.

A good choice for the number of iterative steps computed in each phase is about 25. This is obtained by a value of $K=1.1019$. A normal attack time for an average musical tone is about 0.025 seconds. Thus a normal attack/decay is generated with an envelope modulation timing clock for an individual tone generator at a frequency of 2 khz. A legato attack/release time should be about four times larger than the normal time. Thus a value of $K=0.2755$ is a suitable choice for the legato mode of the attack/decay envelope modulation.

Figure 6:
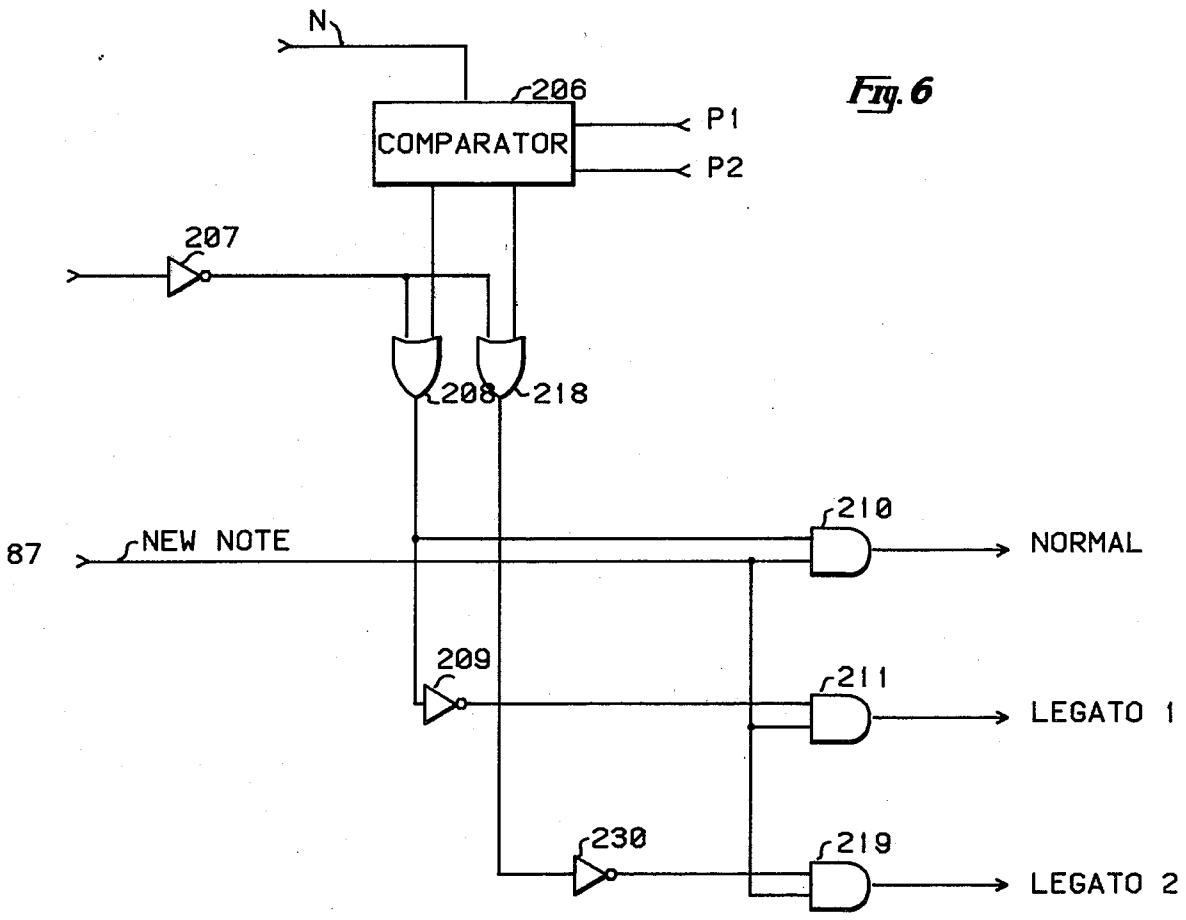
FIG. 6 is a schematic diagram of a multiple speed legato detector.

The legato system described above can be readily extended to provide intermediate attack/decay times between that previously called normal and legato. One modification is to provide one, or more input constants to the comparator 206. Such an arrangement is shown in FIG. 6. The comparator 206 is supplied with selected values of the comparator threshold values P1 and P2. Assume that P2 is greater than P1. The LEGATO 1 will be generated when a new note signal is present on line 87 if the count state of counter 205 if D is greater than P1 but less than P2. The LEGATO 2 signal will be generated when the value of D is greater than P2 but less than the maximum count U.

It is a relatively easy matter to extend the implementation of the ADSR generator 54 to accomodate more than one LEGATO control signal. The essential change is in the addressing of the K-value memory 502.

Figure 7:
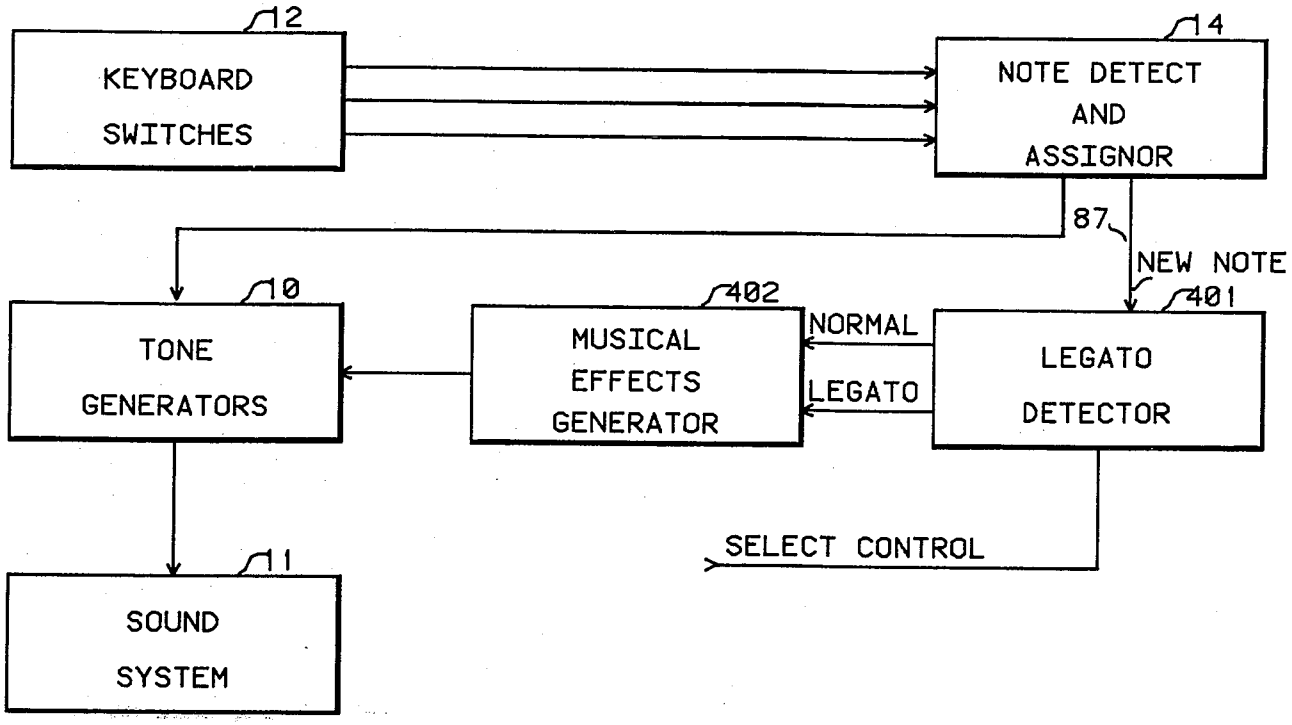
FIG. 7 is a schematic system diagram of alternative embodiments of the invention.

The legato/normal control signals can readily be used for other desirable musical tone effects control. FIG. 7 illustrates the general system configuration for employing the NORMAL and LEGATO control signals to select musical effects.

The musical effects generator 402 can be implemented to contain two electrically switchable stop switches (also called tone switches). The first stop switch is selected in response to the NORMAL signal and the second stop switch is selected in response to the LEGATO signal. The selected stop switch is used to generate a predetermined musical sound by the set of assigned tone generators. The musical result is one in which the generated tones will automatically and adaptively change in response to the spacing between successive actuated notes.

The musical effects generator 402 can be implemented as a low frequency oscillator operating at the vibrato frequency of about 5 hz. The oscillator is selectively turned on by the LEGATO signal and is turned off by the NORMAL signal. It can also be turned off by the absence of the LEGATO signal. The vibrato oscillator is used to frequency modulate the timing clocks associated with the tone generators 10 to produce the musical effect known as vibrato. The musical effect is one in which the vibrato is automatically and adaptively applied in response to the time spacing between successive actuated notes. This effect is distinctively different from the musical control effect called delayed vibrato. It more closely imitates the manner in which many acoustical orchestral type instruments are played.

Figure 8:
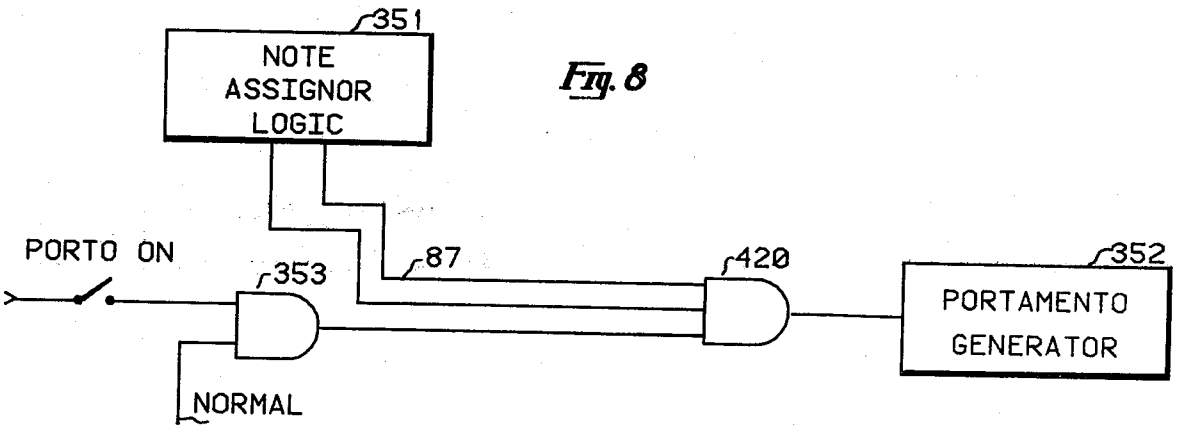
FIG. 8 is a schematic diagram of a portamento control system.

The musical effects generator 402 can be implemented as a portamento generator of almost any of the state-of-the-art types. The portamento generator can be implemented in the manner described in U.S. Pat. No. 4,103,581 entitled "Constant Speed Portamento." This patent is hereby incorporated by reference. To combine the present invention with the portamento system described in the patent an AND-gate 353 is added between the "PORT ON" signal to AND-gate 420 shown in FIG. 8 and in the referenced patent drawing. One input to the added AND-gate 353 is the "PORT ON" signal and the second signal is the LEGATO control signal. The output of the added AND-gate replaces the "PORT ON" signal to AND-gate 420. A very desirable musical effect is obtained in this manner. One does not wish to have a portamento frequency transition between every two successive notes as is the case with the usual portamento system. This constant transition is particularly annoying in fast musical passages. The described combination using the LEGATO control signal provides a portamento effect which is automatically adaptive to the musical players' technique in playing normal and legato passages.

I claim:

1. In combination with a keyboard operated electronic musical instrument having keying means comprising an array of keyswitches operable between actuated and released states, apparatus for producing musical tones having tone envelopes responsive to the time intervals between successive actuated states of the keyswitches comprising:

a detection means for detecting state changes of said keying means, a plurality of tone generators for providing musical waveshape signals, an assignor means responsive to said detection means for selecting members of said plurality of tone generators, an interval measuring means responsive to said detected state changes, whereby a time interval number is generated corresponding to the elapsed time between successive actuated states of keyswitches in said array of keyswitches, an interval detection means responsive to said time interval number wherein a plurality of control signals are generated, an envelope function generator responsive to said plurality of control signals for generating tone envelope functions, and a multiplier means wherein said musical waveshapes provided by said selected members of said plurality of tone generators are multiplied by said tone envelope function.

2. Apparatus according to claim 1 wherein said interval detection means generates a first control signal if said time interval number is less than a preselected interval time number and wherein a second control signal is generated if said time interval number is greater than said preselected interval time number.

3. In combination with a keyboard operated electronic musical instrument having keying means comprising an array of keyswitches operable between actuated and released states, apparatus for producing musical tones having tone envelopes responsive to the time intervals between successive actuated states of the keyswitches comprising;

a master clock for providing timing signals, a detection means for detecting state changes of said keying means, a plurality of tone generators for providing musical waveshape signals, an assignor means responsive to said detection means for selecting members of said plurality of tone generators, an interval counter for counting said timing signals modulo a preselected number U, a gating means interposed between said master clock and said interval counter whereby said timing signals are provided to said interval counter in response to a first gating signal and whereby said timing signals are not provided to said interval counter in response to a second gating signal, a first signal generation means for generating said first gating signal in response to detected state changes from said detection means, a second signal generator means responsive to contents of said interval counter wherein said second gating signal is generated when said interval counter is incremented to a count state equal to said preselected number U, a comparison means whereby a comparison signal is generated if contents of said interval counter is less than a second preselected number P, where P is less than said preselected number U, third signal generator means responsive to said first gating signal and said comparison signal for generating a plurality of control signals, an envelope function generator responsive to said plurality of control signals for generating tone envelope functions, and a utilization means wherein said musical waveshapes provided by said selected members of said plurality of tone generators are multiplied by said tone envelope functions.

4. Apparatus according to claim 3 wherein said third signal generator comprises;

signal generation circuitry responsive to said detection means whereby a first control signal is generated if said comparison signal is generated or if said first gating signal is not generated, whereby a second control signal is generated if said comparison signal is not generated.

5. Apparatus according to claim 4 wherein said envelope function generator comprises circuitry for generating a first tone envelope function in response to said first control signal and for generating a second tone envelope function in response to said second control signal.

6. In combination with a keyboard operated electronic musical instrument having keying means comprising an array of keyswitches operable between actuated and released states, apparatus for producing musical effects responsive to the time intervals between successive actuated states of the keyswitches comprising;

a detection means for detecting state changes in said array of keyswitches, a plurality of tone generators for providing musical waveshape signals, an interval measuring means responsive to said detected state changes whereby a time interval number is generated corresponding to the elapsed time between successive actuated states of keyswitches in said array of keyswitches, an interval detection means responsive to said time interval number wherein a plurality of control signals are generated, and musical effect means responsive to said plurality of control signals for selectively modifying said musical waveshape signals.

7. Apparatus according to claim 6 wherein said interval detection means generates a first control signal if said time interval number is less than a preselected interval time number and wherein a second control signal is generated if said time interval number is greater than said preselected time interval number.

8. Apparatus according to claim 7 wherein said musical effect means comprises;

a vibrato oscillator for producing frequency modulation in said plurality of tone generators in response to said second control signal.

9. Apparatus according to claim 7 wherein said musical effect means comprises;

waveshape generating means associated with each of said plurality of tone generators whereby a first waveshape and a second waveshape are generated, and tone switch means whereby said first waveshape is selected in response to said first control signal and whereby said second waveshape is selected in response to said second control signal.

10. Apparatus according to claim 7 wherein said music effect means comprises;

a portamento generating means for producing portamento frequency transitions in said plurality of tone generators in response to said second control signal.

* * * * *